US008113118B2

(12) United States Patent
Schmidt et al.

(10) Patent No.: US 8,113,118 B2
(45) Date of Patent: Feb. 14, 2012

(54) SPIN SENSOR FOR LOW SPIN MUNITIONS

(75) Inventors: Robert P. Schmidt, Mound, MN (US); Mark J. Tomes, Plymouth, MN (US)

(73) Assignee: Alliant Techsystems Inc., Arlington, VA (US)

( * ) Notice: Subject to any disclaimer, the term of this patent is extended or adjusted under 35 U.S.C. 154(b) by 583 days.

(21) Appl. No.: 10/994,497

(22) Filed: Nov. 22, 2004

(65) Prior Publication Data

US 2007/0181028 A1 Aug. 9, 2007

(51) Int. Cl.
*F42C 15/22* (2006.01)

(52) U.S. Cl. ..... 102/244; 102/237

(58) Field of Classification Search ..... 102/237–244
See application file for complete search history.

(56) References Cited

U.S. PATENT DOCUMENTS

| | | | | | |
|---|---|---|---|---|---|
| 3,750,583 | A | * | 8/1973 | White et al. | 102/221 |
| 3,750,589 | A | * | 8/1973 | Egli et al. | 102/237 |
| 3,750,593 | A | * | 8/1973 | Zetterlund | 104/172.2 |
| 3,760,726 | A | * | 9/1973 | Overman | 102/222 |
| 4,004,519 | A | * | 1/1977 | Hopkins | 102/208 |
| 4,072,108 | A | * | 2/1978 | Lewis et al. | 102/209 |
| 4,214,533 | A | | 7/1980 | Fine et al. | |
| 4,220,952 | A | * | 9/1980 | Whiteley et al. | 102/214 |
| 4,513,664 | A | | 4/1985 | Edmonds | |
| 4,568,039 | A | * | 2/1986 | Smith et al. | 244/3.15 |
| 4,580,498 | A | | 4/1986 | Abt et al. | |
| 4,676,167 | A | * | 6/1987 | Huber et al. | 102/393 |
| 4,676,456 | A | * | 6/1987 | Grosso et al. | 244/3.21 |
| 4,694,752 | A | | 9/1987 | Titus | |
| 4,726,291 | A | * | 2/1988 | Lefranc | 102/214 |
| 5,065,956 | A | * | 11/1991 | Fattal | 244/3.2 |
| 5,076,511 | A | | 12/1991 | Stein et al. | |
| 5,111,748 | A | * | 5/1992 | Thurner et al. | 102/387 |
| 5,115,742 | A | | 5/1992 | Frazer | |
| 5,157,221 | A | | 10/1992 | Ronn | |
| 5,198,615 | A | | 3/1993 | Robbie et al. | |
| 5,275,107 | A | | 1/1994 | Weber et al. | |
| 5,303,654 | A | | 4/1994 | Held | |

(Continued)

FOREIGN PATENT DOCUMENTS

EP 0228783 A2 7/1987

OTHER PUBLICATIONS

PCT International Search Report, mailed Jul. 4, 2007, for PCT Application No. PCT/US2005/042492.

*Primary Examiner* — David Parsley
(74) *Attorney, Agent, or Firm* — TraskBritt

(57) ABSTRACT

A spin sensor includes a fuze housing, a sense weight and a rotating induction device. The rotating induction device comprises a first rotatable element affixed to the fuze housing and a second rotatable element affixed to the sense weight. The second rotatable element is mechanically coupled to the first rotatable element such that it may rotate relative to the first rotatable element. In addition, the second rotatable element is inductively coupled to the first rotatable element such that the relative rotation between the first rotatable element and the second rotatable element generates a spin signal on an electrical connection to the rotating induction device. The spin signal may be compared to a suitable spin profile to determine if a valid spin environment is present.

20 Claims, 5 Drawing Sheets

U.S. PATENT DOCUMENTS 5,390,604 A 2/1995 Ingersoll
5,425,514 A * 6/1995 Grosso ..... 244/3.22
5,452,864 A * 9/1995 Alford et al. ..... 244/3.23
5,497,704 A 3/1996 Kurschner et al.
5,585,592 A 12/1996 Stearns et al.
5,596,166 A 1/1997 Gould
5,602,713 A * 2/1997 Kurogi et al. ..... 361/249
5,705,766 A 1/1998 Farace et al.
5,740,986 A * 4/1998 Seidensticker et al. ..... 244/3.15
5,886,339 A * 3/1999 Wilson ..... 244/3.2
5,914,459 A 6/1999 Teske et al.
6,065,403 A 5/2000 Haglund
6,151,563 A 11/2000 Marinelli
6,163,021 A 12/2000 Mickelson
6,175,178 B1 1/2001 Tupper et al.
6,378,437 B1 * 4/2002 Burke et al. ..... 102/293
6,433,533 B1 8/2002 Clymer et al.
6,556,896 B1 4/2003 Meyer
6,565,036 B1 * 5/2003 Palathingal et al. ..... 244/3.16
6,598,533 B1 7/2003 Kolbli
6,705,231 B1 * 3/2004 Zacharin ..... 102/231
6,750,576 B2 6/2004 Ehrhart et al.
6,848,648 B2 * 2/2005 Klestadt et al. ..... 244/3.23
6,981,672 B2 * 1/2006 Clancy et al. ..... 244/3.24
7,124,689 B2 * 10/2006 Davis et al. ..... 102/216
7,412,930 B2 * 8/2008 Smith et al. ..... 102/473
2002/0073869 A1 6/2002 Tiernan et al.
2004/0244625 A1 * 12/2004 Tiernan et al. ..... 102/221
2005/0132920 A1 * 6/2005 Ceola ..... 102/221
2005/0183605 A1 * 8/2005 Bishop et al. ..... 102/201

* cited by examiner

SPIN SENSOR FOR LOW SPIN MUNITIONS

CROSS REFERENCE TO RELATED APPLICATIONS

The present application is related to U.S. patent application Ser. No. 10/994,754, filed on Nov. 22, 2004, now U.S. Pat. No. 7,124,689, issued Oct. 24, 2006. The disclosure of the above-mentioned applications is incorporated by reference herein in its entirety.

BACKGROUND OF THE INVENTION

1. Field of the Invention

This invention relates generally to fuzes for explosive devices and, more particularly, to determining an environmental condition related to when an explosive device may be safely armed.

2. Description of Related Art

Explosive projectiles must be capable of being handled safely under considerable stress and environmental conditions. In addition, explosive projectiles must be capable of detonating at the proper time. Depending on the application, this proper time may be before impact at a specific point during flight, during impact, or at some time delay after impact. As used herein the terms "warhead," "explosive device," and "explosive projectile" are generally used to refer to a variety of projectile type explosives, such as, for example, artillery shells, rockets, bombs, and other weapon warheads. In addition, these explosive projectiles may be launched from a variety of platforms, such as, for example, fixed wing aircraft, rotary wing aircraft (e.g., helicopters), ground vehicles, and stationary ground locations. To determine the proper detonation time, these explosive projectiles frequently employ fuzes.

A fuze subsystem activates the explosive projectile for detonation in the vicinity of the target. In addition, the fuze maintains the explosive projectile in a safe condition during logistical and operational phases prior to launch and during the first phase of the launch until the explosive projectile has reached a safe distance from the point of launch. Consequently, major functions that a fuze performs are: keeping the weapon safe, arming the weapon when it is a safe distance from the point of launch, detecting the target, and initiating detonation of the warhead at some definable point after target detection.

The first two functions are conventionally referred to as Safing and Arming (S&A). Safing and Arming devices isolate a detonator from the warhead booster charge until the explosive projectile has been launched and a safe distance from the launch vehicle is achieved. At that point, the S&A device removes a barrier from, or moves the detonator in line with, the warhead, which effectively arms the detonator so it can initiate detonation at the appropriate time.

Some S&A devices function by measuring elapsed time from launch, while others determine distance traveled from the launch point by sensing acceleration experienced by the weapon. Still other devices sense air speed or projectile rotation. For maximum safety and reliability of a fuze, the sensed forces or events must be unique to the explosive projectile when deployed and launched, not during ground handling or pre-launch operations. Most fuzes must determine two independent physical parameters before determining that a launch has occurred and a safe separation distance has been reached.

Detecting spin of the projectile is an often-used physical parameter. However, explosive projectiles that are not shot through a rifled barrel tend to exhibit very low angular accelerations. These smaller angular accelerations and spin rates are more difficult to detect. Conventional spin sensors such as accelerometers and spin switches set to detect these low angular accelerations may be spoofed by accelerations related to platform maneuvers prior to launch.

Other conventional spin sensors detect the Earth's magnetic field and sense changes in position and orientation of the spinning projectile relative to the Earth's magnetic field. These devices may be quite complex and may be susceptible to electro-magnetic noise or electro-static noise.

There is a need for a straightforward device and robust method to sense low angular accelerations of explosive projectiles in flight while being insensitive to cross-axis accelerations from projectile launch. In addition, there is a need to discriminate between platform maneuver accelerations and spin accelerations related to projectile flight after separation from the projectile launch point.

BRIEF SUMMARY OF THE INVENTION

An embodiment of the present invention comprises a spin sensor, including a fuze housing, a sense weight, and a rotating induction device. The rotating induction device comprises a first element affixed to the fuze housing and a second element affixed to the sense weight. The second element is mechanically coupled to the first element such that it may rotate relative to the first element. In addition, the second element is inductively coupled to the first element such that a relative rotation between the first element and the second element generates a spin signal on an electrical connection to the rotating induction device.

Another embodiment of the present invention comprises an explosive projectile including an encasement, an explosive material disposed within the encasement and configured for detonation, and a spin sensor disposed within the encasement. The spin sensor comprises a fuze housing, a sense weight, and a rotating induction device. The rotating induction device comprises a first element affixed to the fuze housing and a second element affixed to the sense weight. The second element is mechanically coupled to the first element such that it may rotate relative to the first element. In addition, the second element is inductively coupled to the first element such that a relative rotation between the first element and the second element generates a spin signal on an electrical connection to the rotating induction device.

Another embodiment of the present invention comprises a method of sensing fuze spin. The method comprises providing a sense weight rotationally coupled to a fuze housing, rotating the fuze housing, and detecting a relative rotation between the sense weight and the fuze housing. The method further comprises converting the detected relative rotation into a spin signal, which is sampled to develop an actual spin profile of the fuze housing. The developed actual spin profile may then be compared to an acceptable spin profile.

Yet another embodiment, in accordance with the present invention comprises a method of sensing fuze spin including inductively coupling a first element affixed to a fuze housing and a second element affixed to a sense weight. The inductive coupling generates a spin signal correlated to a relative rotation of the first element relative to the second element. The spin signal is sampled to develop an actual spin profile of the fuze housing. The developed actual spin profile may then be compared to an acceptable spin profile.

BRIEF DESCRIPTION OF THE DRAWINGS

In the drawings, which illustrate what is currently considered to be the best mode for carrying out the invention.

DETAILED DESCRIPTION OF THE INVENTION

In the following description, circuits and functions may be shown in block diagram form in order not to obscure the present invention in unnecessary detail. Conversely, specific circuit implementations shown and described are exemplary only and should not be construed as the only way to implement the present invention unless specified otherwise herein. Additionally, block definitions and partitioning of logic between various blocks is exemplary of a specific implementation. It will be readily apparent to one of ordinary skill in the art that the present invention may be practiced by numerous other partitioning solutions. For the most part, details concerning timing considerations and the like have been omitted where such details are not necessary to obtain a complete understanding of the present invention and are within the abilities of persons of ordinary skill in the relevant art.

In this description, some drawings may illustrate signals as a single signal for clarity of presentation and description. It will be understood by a person of ordinary skill in the art that the signal may represent a bus of signals, wherein the bus may have a variety of bit widths and the present invention may be implemented on any number of data signals including a single data signal.

In describing the present invention, the systems and elements surrounding the invention are first described to better understand the function of the invention as it may be implemented within these systems and elements.

Figure 1:
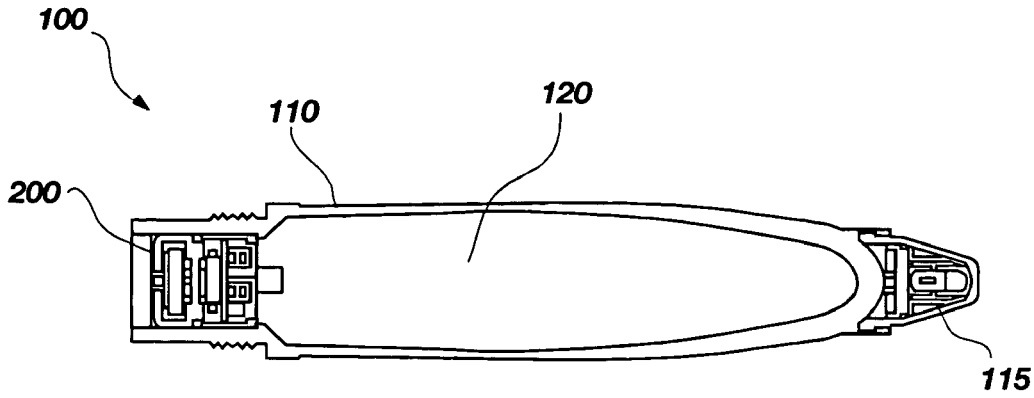
FIG. 1 is a diagram of an exemplary explosive projectile incorporating the present invention.

FIG. 1 illustrates an exemplary embodiment of an explosive projectile 100 (also referred to as a warhead) incorporating the present invention. As illustrated in FIG. 1, the explosive projectile 100 includes a fuze 200 in the base of the explosive projectile 100 and an explosive material 120 encased by a body 110. Additionally, the nose may include impact sensors 115, such as, for example, a crush sensor, and a graze sensor. The FIG. 1 explosive projectile 100 is exemplary only, it will be readily apparent to a person of ordinary skill in the art that the present invention may be practiced or incorporated into a variety of explosive projectiles 100 as described earlier.

Figure 2:
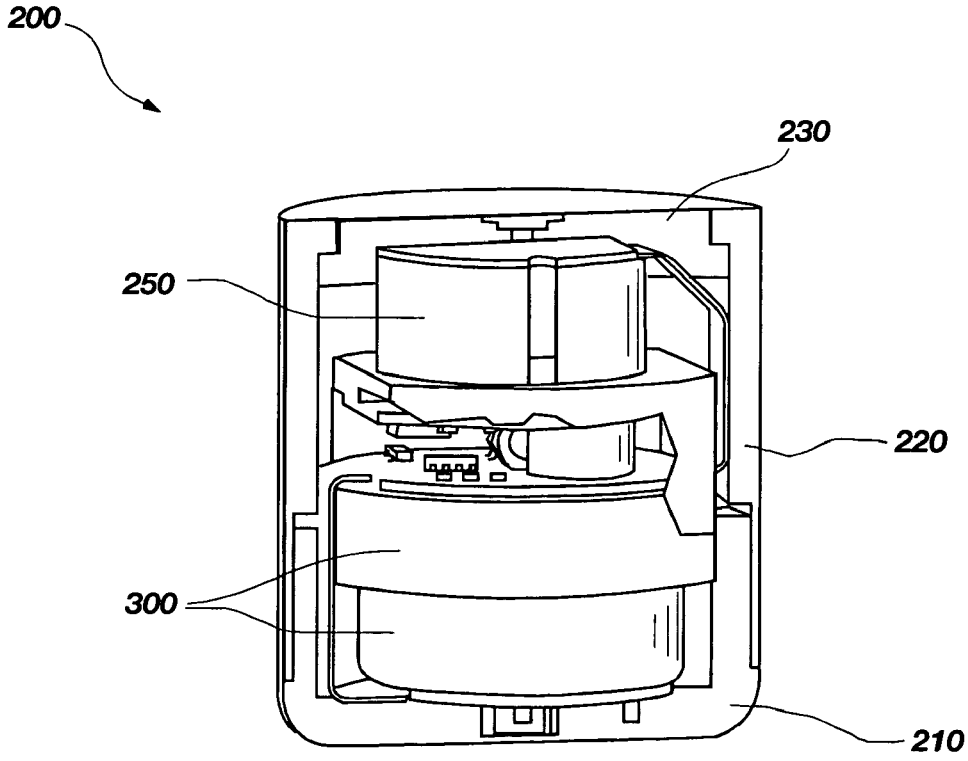
FIG. 2 is a cut-away three-dimensional view of an exemplary fuze incorporating the present invention.

FIG. 2 illustrates an exemplary embodiment of the fuze 200 incorporating the present invention. As illustrated in FIG. 2, the exemplary fuze 200 includes elements forming an encasement for the fuze 200 including a base 210, a fuze housing 220, and an end cap 230. The functional elements within the encasement include a safety and arming module (S&A module) 250, and a spin sensor 300. In the exemplary embodiment of an explosive projectile 100 illustrated in FIG. 1, the fuze 200 is mounted in the aft end. The aft location places the fuze 200 within the "buried" warhead section adjacent to the rocket motor/guidance section, which is a relatively ineffective location for fragmentation, and is well suited for the fuze 200. In addition, this location prevents the fuze 200 from interfering with forward fragmentation and allows an unobstructed forward target view for other sensors, such as, for example, proximity sensors. However, while the aft location is used in the exemplary embodiment of FIG. 1, other locations and configurations are contemplated within the scope of the invention.

As explained earlier, part of the S&A function is to prevent premature detonation. The exemplary fuze embodiment may incorporate multiple independent environments to determine that the explosive projectile 100 may be safely armed. One environment incorporated in the exemplary embodiment of the fuze 200 is spin sensing. Spin sensing may be used to determine that the explosive projectile 100 has been launched and is following a normal trajectory wherein the spin may be caused by a rifled barrel or the aerodynamic characteristics of the explosive projectile 100.

Figure 3:
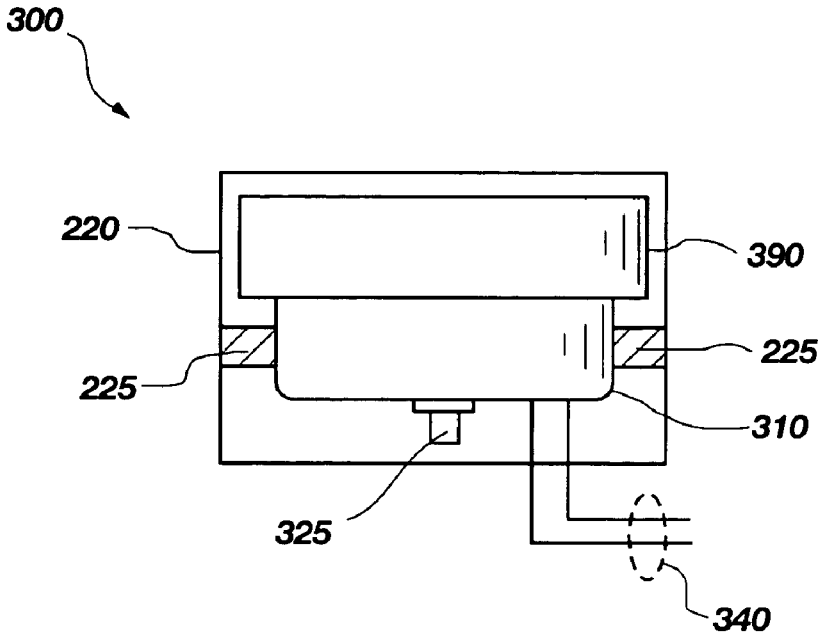
FIG. 3 is a view of an exemplary rotating induction device and sense weight in a fuze housing according to the present invention.

FIG. 3 illustrates an exemplary spin sensor 300 according to the present invention. The spin sensor 300 includes a sense weight 390, a rotating induction device 310, and a spin signal 340. The sense weight 390 behaves as a flywheel, which creates an inertial mass that resists angular acceleration. The sense weight's mass and configuration may be modified to affect the amount of inertial force resisting angular acceleration. This modification enables adaptation of the spin sensor 300 to various spin rates and spin accelerations that may be expected of the various explosive projectiles during normal flight.

The rotating induction device 310 may be a device such as an alternator or an electric motor and may also be referred to herein as an alternator 310 or as an electric motor 310. Generally, an exemplary alternator 310 includes a first element affixed to the fuze housing 220 and a second element affixed to the sense weight 390. The first element and the second element are rotationally coupled and inductively coupled. In various embodiments, the first element may be a stator of the alternator 310 or a rotor of the alternator 310. Similarly, the second element may be a rotor of the alternator 310 or a stator of the alternator 310.

Figure 4:
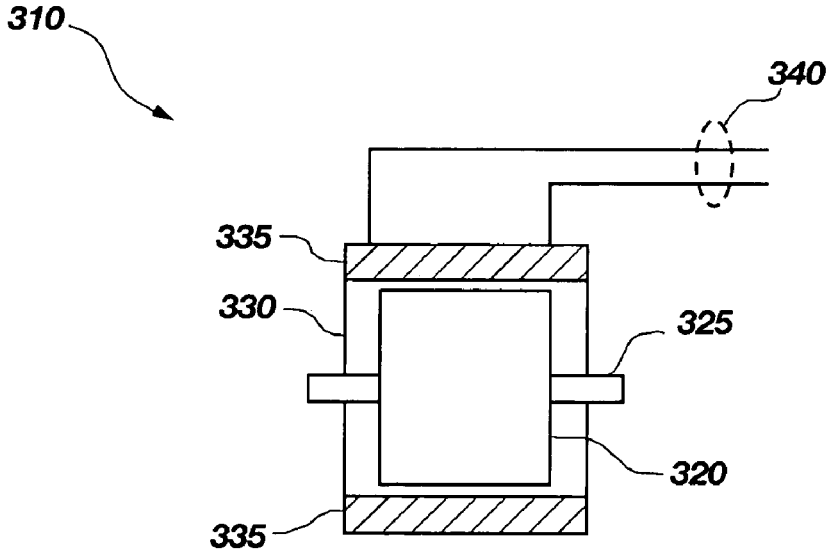
FIG. 4 is a sectional view of an exemplary rotating induction device according to the present invention.

As shown in FIG. 4, the alternator 310 includes a rotor 320 attached to a shaft 325, a stator 330, and an electrical connection to a wire coil 335 within the stator 330. The spin signal 340 may be generated in the wire coil 335 and electrical connection as the rotor 320 spins relative to the stator 330. As depicted in FIG. 4, the alternator 310 may be a conventional alternating current (AC) alternator 310 or electric motor. As an AC alternator 310, the rotor 320 comprises a permanent magnet, which, when it rotates, causes a rotating magnetic field. The stator 330 includes a wire coil 335, which, when exposed to the rotating magnetic field, generates an AC electric signal in the wire coil 335 and spin signal 340 connected to the wire coil 335.

In the exemplary embodiment of the spin sensor 300 shown in FIG. 3, the sense weight 390 is attached to the rotor 320, while the fuze housing 220 is attached to the stator 330 through housing attachments 225. This configuration allows the sense weight 390 and rotor 320 to freely rotate (or resist rotation) within the fuze housing 220, while the stator 330, attached to the fuze housing 220, rotates at the same rate as the explosive projectile 100. As the explosive projectile 100 begins to spin during flight, the stator 330 will also spin. However, the sense weight 390 and rotor 320 may resist spinning due to their inertial mass. As a result, a relative rotation develops between the rotor 320 and stator 330, causing the coil to generate an AC signal on the spin signal 340. Clearly, the housing attachments 225 are exemplary only. Many attachment mechanisms are possible and contemplated as within the scope of the invention.

Figure 5:
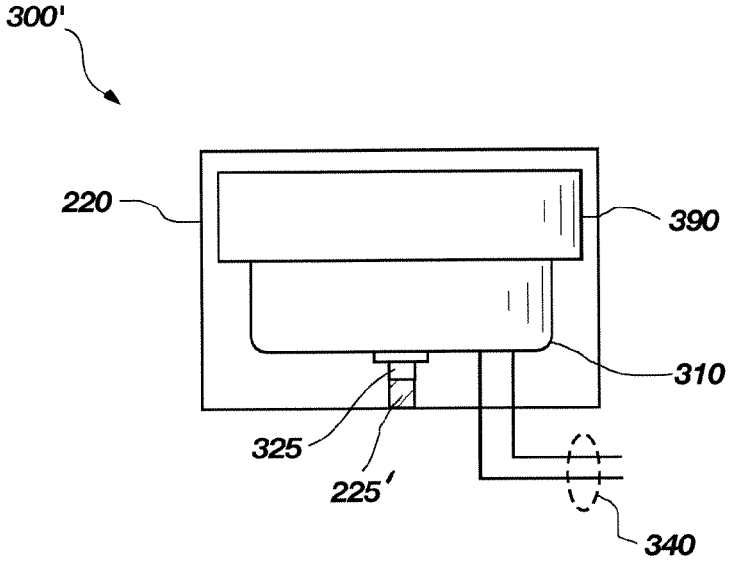
FIG. 5 is another view of an exemplary rotating induction device and sense weight in a fuze housing according to the present invention.

In another embodiment of the spin sensor 300' shown in FIG. 5, the sense weight 390 may be attached to the stator 330, while the fuze housing 220 is attached to the rotor 320 through housing attachment 225'. This embodiment may enable a smaller sense weight 390 since the inertial mass of the stator 330 would be included with the inertial mass of the sense weight 390 in resisting angular acceleration. Operation of this embodiment is similar to the previous embodiment except that the stator 330 spins freely and the rotor 320 spins with the explosive projectile 100. Clearly, the housing attachment 225' of the embodiment of FIG. 5 is exemplary only. Many attachment mechanisms are possible and contemplated as within the scope of the invention.

Figure 6:
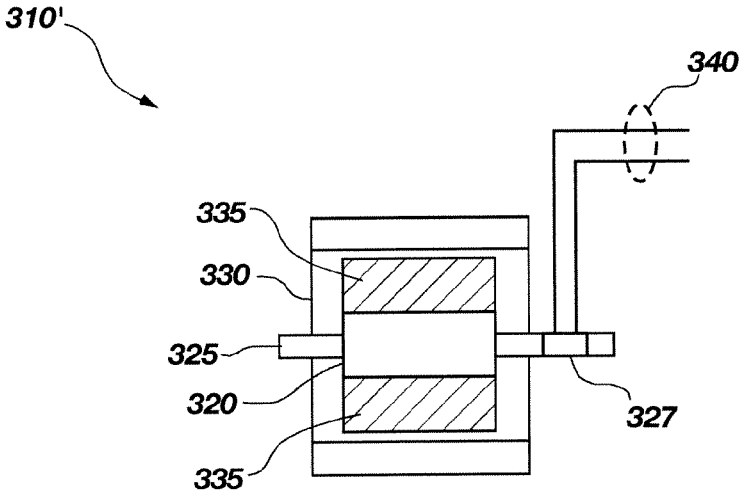
FIG. 6 is a sectional view of another exemplary rotating induction device according to the present invention.

In another embodiment, rather than using a conventional AC alternator 310 or AC motor, a direct current (DC) alternator 310' or DC motor may be used, as shown in FIG. 6. In a conventional DC alternator 310', the wire coil 335 is part of the rotor 320 and connects to the spin signal 340 through a commutator 327. The stator 330, therefore, includes the permanent magnet. As with the AC alternator 310, a DC alternator 310' may be configured with the rotor 320 connected to the sense weight 390 and the stator 330 connected to the fuze housing 220. Alternatively, the rotor 320 may be connected to the fuze housing 220 and the stator 330 may be connected to the sense weight 390.

Conventional alternators and electric motors exhibit an attribute known as magnetic detent. This is an angular resistance to relative rotation between the rotor 320 and stator 330. The rotor 320 and stator 330 may not rotate relative to one another until a relative angular acceleration is large enough to overcome the force of the magnetic detent. In the present invention, magnetic detent may be used to resist relative rotation of the rotor 320 and stator 330 for small angular accelerations or vibrations that may be encountered during platform maneuvers or transportation of the explosive projectile 100. Furthermore, because the device is not sensitive to these cross-axis accelerations, precise alignment of the sensor to the longitudinal axis of the explosive projectile 100 is not needed.

Figure 7:
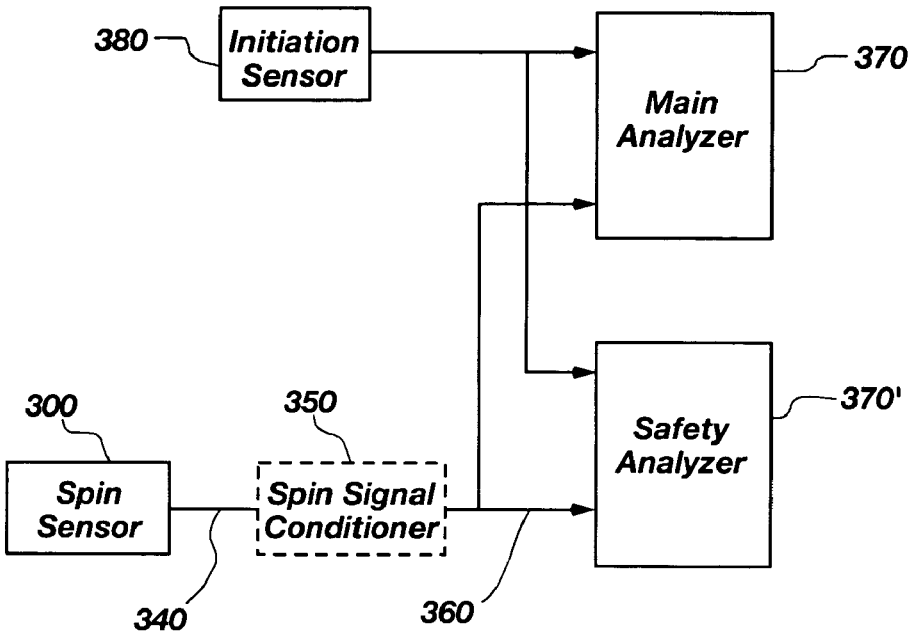
FIG. 7 is an exemplary electronics module for conditioning and sensing of a spin signal according to the present invention.

FIG. 7 illustrates an exemplary embodiment of an electronics module for sampling and analyzing the spin signal 340. In the FIG. 7 embodiment, the spin signal 340 from the spin sensor 300 may be optionally connected to a spin signal conditioner 350. If a spin signal conditioner 350 is used, the resulting conditioned spin signal 360 may be connected to a main analyzer 370 and a safety analyzer 370'. If a spin signal conditioner 350 is not used, the spin signal 340 may be directly connected to the main analyzer 370 and the safety analyzer 370' (connection not shown). An initiation sensor 380 may be included with the electronics module or may be located in another position within the fuze 200 or explosive projectile 100 (FIG. 1) and connected to the electronics module through suitable wiring and connectors. The initiation sensor 380 may be a type of sensor that detects a launch event, such as, for example, an acceleration switch or accelerometer.

This exemplary embodiment employs redundant, low power microcontrollers as the main analyzer 370 and the safety analyzer 370'. In the exemplary embodiment, the safety analyzer 370' is a different part from a different vendor than the main analyzer 370. The dual-analyzer configuration using differing parts enables a cross-checking architecture, which may eliminate both single point and common mode failures. However, other analyzer configurations are contemplated within the scope of the present invention. For example, a single analyzer may be used or more than two analyzers may be used to enable additional redundancy and safeguards against failures.

It may be advantageous to condition the spin signal 340 generated from the alternator 310 (FIG. 4) to generate the conditioned spin signal 360, which may then be sampled by the analyzers 370 and 370'. For example, the spin signal 340 may be filtered to remove unwanted noise. In addition, the spin signal 340 may be amplified or attenuated to voltage levels compatible with the analyzers 370 and 370'. The spin signal 340 may also be digitized, either by a circuit in the spin signal conditioner 350, or by circuits or software in the analyzers 370 and 370'.

Figure 8:
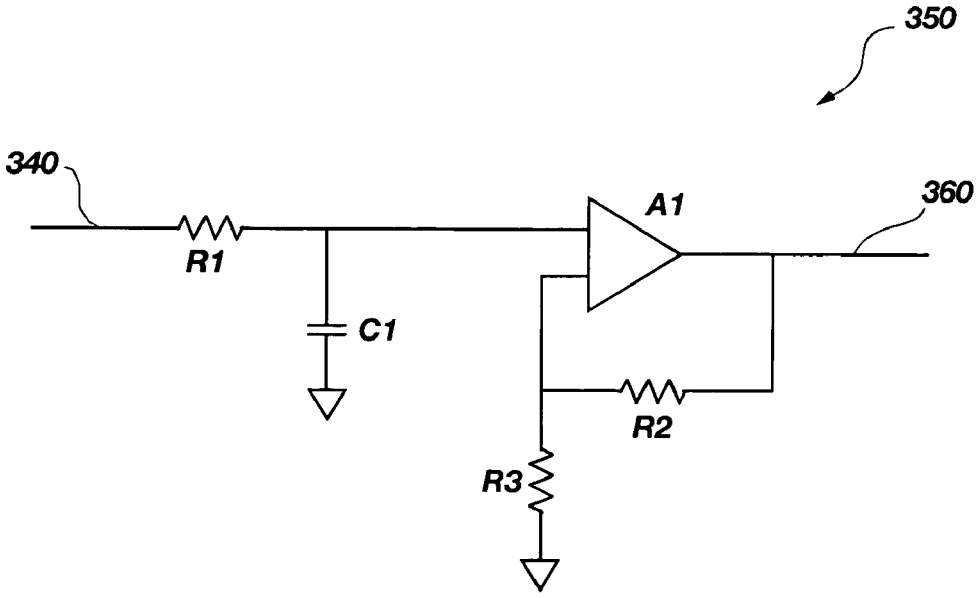
FIG. 8 is an exemplary spin signal conditioner according to the present invention.

FIG. 8 illustrates an exemplary spin signal conditioner 350. In this spin signal conditioner 350, resistor R1 and capacitor C1 form a simple low pass filtering function to eliminate potential high frequency noise. Resistor R2 and Resistor R3 form a voltage divider, which acts in conjunction with the operational amplifier A1 to form a simple two-state digitizer. The voltage divider defines a voltage threshold for the digitizer. The digitizer acts to drive the conditioned spin signal 360 high any time the spin signal 340 exceeds the voltage threshold and to drive the conditioned spin signal 360 low any time the spin signal 340 goes below the voltage threshold. Of course, if the analyzers 370 and 370' (FIG. 7) are configured to evaluate a multi-state-digitized signal, a more complex analog-to-digital converter may be implemented in the spin signal conditioner 350, or within the analyzers 370 and 370'. A person of ordinary skill in the art will recognize that many other implementations and modifications of the spin signal conditioner 350 are possible and contemplated as within the scope of the present invention.

Figure 9:
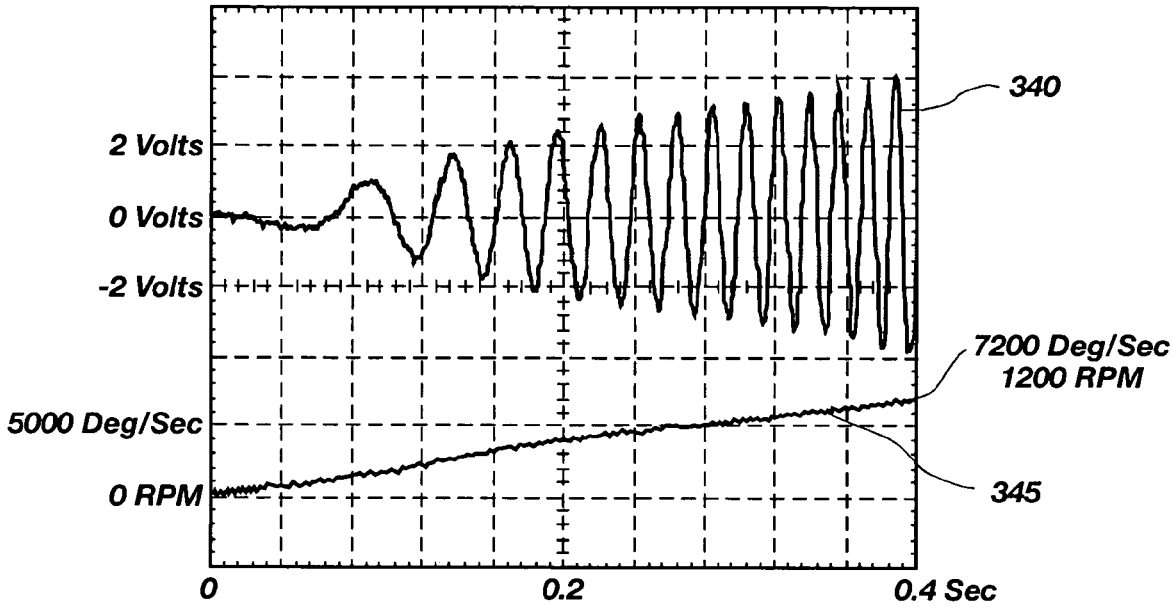
FIG. 9 is a graph illustrating a signal and spin rate of the exemplary spin signal according to the present invention.

FIG. 9 includes waveforms to illustrate an exemplary spin signal 340 and a rotation rate waveform 345. Initially, the spin signal 340 is shown as beginning at zero volts. Then, as the alternator 310 begins relative rotation, the spin signal 340 begins to oscillate. It can be seen from the spin signal 340 that the spin signal 340 increases in amplitude during the time period shown on the waveform. Also, the rotation rate waveform 345 illustrates the increasing frequency of the spin signal 340 during the same time period. The analyzers 370 and 370' (FIG. 7) may use the characteristics of the spin signal 340 to develop a spin profile for the explosive projectile 100 (FIG. 1).

In operation of the exemplary embodiment of the spin sensor 300 shown in FIG. 3, the stator 330 portion of the alternator 310 is affixed to the fuze 200 substantially along a longitudinal axis of the explosive projectile 100 (FIG. 1). As a result, as the explosive projectile 100 spins after launch the stator 330 spins. Due to the magnetic detent of the alternator 310, spin will not result in relative rotation between the rotor 320 and the stator 330 until an angular acceleration threshold greater than the magnetic detent is exceeded. When the magnetic detent is overcome, the inertial mass of the sense weight 390 combined with the rotor 320 resists spinning, causing relative rotation between the rotor 320 and stator 330 of the alternator 310. The relative rotation generates an AC signal on the spin signal 340, which may be sensed by the main analyzer 370 and safety analyzer 370' (FIG. 7). The spin signal 340 may be processed to develop an actual spin profile, which may be compared to an acceptable spin profile to determine if the spin signal 340 conforms to expectations of normal flight of the explosive projectile 100. Acceptable spin profiles may be developed from modeling or empirical testing and analysis of the explosive projectile 100. In addition, the analyzers 370 and 370' may include multiple acceptable spin profiles stored within them, enabling the proper acceptable spin profile to be selected at an appropriate time, such as, for example, a user selection prior to launch. A variety of parameters may be included in the actual spin profile and the acceptable spin profile, such as, for example, revolution count, spin rate, increase in spin rate and spin signal amplitude.

By way of one, nonlimiting example, an acceptable spin profile may be defined as at least four transitions from the spin sensor 300, with each transition occurring at an increasing rate. The system may be configured such that the main analyzer 370 and the safety analyzer 370' wait for a signal from the initiation sensor 380 indicating a valid launch event. After a valid launch event, the analyzers 370 and 370' may sample the spin signal 340 to develop the actual spin profile. If the actual spin profile conforms to the acceptable spin profile, the analyzers 370 and 370' may signal that a valid spin environment has been achieved. If the actual spin profile does not conform to the acceptable spin profile within an expected time window, a valid spin environment may have not been achieved and the fuze 200 may be shut down.

In addition, if multiple analyzers are used, a valid spin environment may require all analyzers to reach a same conclusion on a comparison of the actual spin profile to the acceptable spin profile. Of course, a person of ordinary skill in the art will recognize that many other spin profiles are contemplated within the scope of the present invention.

Although this invention has been described with reference to particular embodiments, the invention is not limited to these described embodiments. Rather, the invention is limited only by the appended claims, which include within their scope all equivalent devices or methods that operate according to the principles of the invention as described.

What is claimed is:

1. A spin sensor, comprising:
a fuze housing;
a sense weight for providing an inertial mass; and
a rotating induction device comprising:
a first element affixed to the fuze housing via attachments extending between the fuze housing and the first element;
a second element affixed to the sense weight via a shaft, the second element inductively coupled and rotationally coupled to the first element with the second element being disposed entirely within the first element, wherein the first element and the fuze housing are configured to rotate with respect to the second element and the sense weight; and
an electrical connection configured to convey a signal developed in response to rotation of the fuze housing with respect to the sense weight;
wherein the sense weight is configured such that the inertial mass provides an angular inertial force impeding angular acceleration of the second element when the fuze housing rotates.

2. The spin sensor of claim 1, further comprising at least one analyzer operably coupled to the spin signal, the at least one analyzer configured for sampling the spin signal to develop an actual spin profile and comparing the actual spin profile to an acceptable spin profile.

3. The spin sensor of claim 2, wherein the acceptable spin profile and the actual spin profile incorporate at least one spin parameter selected from the group consisting of revolution count, spin rate, increase in spin rate and spin signal amplitude.

4. The spin sensor of claim 2, wherein the at least one analyzer comprises at least one programmable controller.

5. The spin sensor of claim 1, further comprising:
a spin signal conditioner operably coupled to the spin signal and configured for generating a conditioned spin signal; and
at least one analyzer operably coupled to the conditioned spin signal, the at least one analyzer configured for sampling the conditioned spin signal to develop an actual spin profile and comparing the actual spin profile to an acceptable spin profile.

6. The spin sensor of claim 5, wherein the acceptable spin profile and the actual spin profile incorporate at least one spin parameter selected from the group consisting of revolution count, spin rate, increase in spin rate and spin signal amplitude.

7. The spin sensor of claim 5, wherein the at least one analyzer comprises at least one programmable controller.

8. The spin sensor of claim 5, wherein the spin signal conditioner is configured to generate the conditioned spin signal by modifying the spin signal, the modification including at least one function selected from the group consisting of filtering, amplifying, attenuating, and digitizing.

9. The spin sensor of claim 1, wherein a magnetic detent attribute of the rotating induction device maintains the relative rotation at substantially near zero until a relative angular acceleration threshold between the first element and the second element is exceeded.

10. The spin sensor of claim 1, wherein the first element is a stator of the rotating induction device and the second element is a rotor of the rotating induction device.

11. The spin sensor of claim 10, wherein the stator comprises a wire coil and the rotor comprises a permanent magnet.

12. The spin sensor of claim 10, wherein the stator comprises a permanent magnet and the rotor comprises a wire coil.

13. The spin sensor of claim 1, wherein the first element is a rotor of the rotating induction device and the second element is a stator of the rotating induction device.

14. The spin sensor of claim 13, wherein the stator comprises a wire coil and the rotor comprises a permanent magnet.

15. The spin sensor of claim 13, wherein the stator comprises a permanent magnet and the rotor comprises a wire coil.

16. An explosive projectile, comprising:
an encasement;
an explosive material disposed within the encasement and configured for detonation; and
a fuze disposed within the encasement, comprising:
a fuze housing;
a sense weight for providing an inertial mass; and
a rotating induction device comprising:
a first element affixed to the fuze housing via attachments extending between the fuze housing and the first element;
a second element affixed to the sense weight via a shaft, the second element inductively coupled and rotationally coupled to the first element with the second element being disposed entirely within the first element, wherein the first element and the fuze housing are configured to rotate with respect to the second element and the sense weight; and an electrical connection generating a substantially sinusoidal spin signal responsive to the inductive coupling and having an increasing amplitude and frequency correlated with multiple relative rotations between the first element and the second element;

wherein a rate of the relative rotations and the frequency of the spin signal are responsive to the inertial mass providing an angular inertial force impeding angular acceleration of the second element when the fuze housing rotates.

17. The explosive projectile of claim 16, wherein the first element is a stator of the rotating induction device and the second element is a rotor of the rotating induction device.

18. The explosive projectile of claim 16, wherein the first element is a rotor of the rotating induction device and the second element is a stator of the rotating induction device.

19. The explosive projectile of claim 16, further comprising at least one analyzer operably coupled to the spin signal, the at least one analyzer configured for sampling the spin signal to develop an actual spin profile and comparing the actual spin profile to an acceptable spin profile.

20. The explosive projectile of claim 19, wherein the acceptable spin profile and the actual spin profile incorporate at least one spin parameter selected from the group consisting of revolution count, spin rate, increase in spin rate and spin signal amplitude.

* * * * *

UNITED STATES PATENT AND TRADEMARK OFFICE

CERTIFICATE OF CORRECTION

PATENT NO. : 8,113,118 B2
APPLICATION NO. : 10/994497
DATED : February 14, 2012
INVENTOR(S) : Robert P. Schmidt and Mark J. Tomes It is certified that error appears in the above-identified patent and that said Letters Patent is hereby corrected as shown below:

On the title page:

In ITEM (56) References Cited

U.S. PATENT DOCUMENTS

Page 1, Column 1, 3rd entry (Line 33) delete "3,750,593 A * 8/1973 Zetterlund ... 104/172.2"

Signed and Sealed this
Twenty-fifth Day of March, 2014

Michelle K. Lee

Michelle K. Lee
*Deputy Director of the United States Patent and Trademark Office*